US010498078B2

(12) United States Patent
Suzuki et al.

(10) Patent No.: US 10,498,078 B2
(45) Date of Patent: Dec. 3, 2019

(54) LEVER-TYPE CONNECTOR

(71) Applicant: Sumitomo Wiring Systems, Ltd., Yokkaichi, Mie (JP)

(72) Inventors: Masakazu Suzuki, Mie (JP); Kazuo Nakai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/293,754

(22) Filed: Mar. 6, 2019

(65) Prior Publication Data

US 2019/0296484 A1 Sep. 26, 2019

(30) Foreign Application Priority Data

Mar. 23, 2018 (JP) ..... 2018-055748

(51) Int. Cl.
*H01R 13/629* (2006.01)
*H01R 13/502* (2006.01)

(52) U.S. Cl.
CPC ..... *H01R 13/62955* (2013.01); *H01R 13/502* (2013.01); *H01R 13/6295* (2013.01); *H01R 13/62938* (2013.01)

(58) Field of Classification Search
CPC ..... H01R 13/62955; H01R 13/502; H01R 3/62938; H01R 3/62933; H01R 3/6295
USPC ..... 439/372
See application file for complete search history.

(56) References Cited

U.S. PATENT DOCUMENTS 6,827,593 B2 * 12/2004 Shinozaki ..... H01R 13/62955 439/157
7,476,116 B2 * 1/2009 Shinozaki ..... H01R 13/62938 439/345
9,124,033 B2 * 9/2015 Hirano ..... H01R 13/62955
9,153,910 B2 * 10/2015 Aoki ..... H01R 13/62938
9,705,251 B2 * 7/2017 Noro ..... H01R 13/62955
2003/0166351 A1 * 9/2003 Shinozaki ..... H01R 13/62938 439/157
2012/0318645 A1 * 12/2012 Kobayashi ..... H01H 9/0066 200/50.01
2016/0226187 A1 * 8/2016 Sakamoto ..... H01R 13/64
2016/0336686 A1 * 11/2016 Obata ..... H01R 13/62938
(Continued)

FOREIGN PATENT DOCUMENTS

JP 2013-48046 3/2013

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A lever-type connector (A) includes a lever (20) to be rotated from an initial position to a connection position in connecting the lever-type connector (A) to a mating connector (B) and located at a retracted position not corresponding to terminal insertion openings (16) in inserting terminal fittings (13) into terminal accommodation chambers (12), a separation restricting lock arm (31) formed on the connector body (10), capable of locking the lever (20) at the connection position in a state where rotation toward the initial position is restricted and configured to unlock the lever (20) by being resiliently deformed, and an excessive rotation restricting lock arm (35) formed on the connector body, capable of locking the lever (20) at the connection position in a state where rotation toward the retracted position is restricted and configured to unlock the lever (20) by being resiliently deformed.

9 Claims, 13 Drawing Sheets

(56) References Cited

U.S. PATENT DOCUMENTS

| | | | | |
|---|---|---|---|---|
| 2017/0279222 | A1* | 9/2017 | Kayano | H01R 13/62933 |
| 2017/0346223 | A1* | 11/2017 | Chikusa | H01R 13/428 |
| 2017/0346225 | A1* | 11/2017 | Kanda | H01R 13/62955 |
| 2017/0346226 | A1* | 11/2017 | Kanda | H01R 13/62977 |
| 2018/0062312 | A1* | 3/2018 | Shindo | H01R 13/62938 |
| 2018/0069345 | A1* | 3/2018 | Shimizu | H01R 13/62938 |
| 2018/0069346 | A1* | 3/2018 | Shimizu | H01R 13/502 |
| 2018/0083385 | A1* | 3/2018 | Akagi | H01R 13/62938 |

* cited by examiner

LEVER-TYPE CONNECTOR

BACKGROUND

Field of the Invention

The invention relates to a lever-type connector.

Related Art

Japanese Unexamined Patent Publication No. 2013-048046 discloses a lever-type connector configured to connect a connector and a mating connector by rotating a lever provided on a housing from an initial position to a connection position. A terminal accommodation chamber is formed in the housing to receive a terminal fitting, and a terminal insertion opening of the terminal accommodation chamber is open in an outer surface of the housing. A rotating portion of the lever faces the terminal insertion opening when the lever is at the connection position and is an obstacle when inserting the terminal fitting into the terminal accommodation chamber. Thus, the lever is rotated to a terminal insertion position where the rotating portion does not face the terminal insertion opening so that the terminal fitting can be inserted into the housing.

The lever is in the connection position for a long time in this lever-type connector, and therefore, a projecting amount of the lever at the connection position is suppressed to be small when the lever at the connection position. The lever also preferably is held at the connection position when the lever-type connector and the inserted terminal fitting are transported to a site for connection to the mating connector. However, the lever then must be rotated from the connection position to the initial position at the connection site. Thus, a means is desired for holding the lever at the connection position and easily rotating the lever from the connection position to the initial position.

Further, with the lever at the connection position, a maintenance operation or the like may be performed by withdrawing the terminal fitting from the housing. In preparation for such a case, a means is desired for holding the lever at the connection position and easily rotating the lever from the connection position toward the terminal insertion position.

The invention was completed on the basis of the above situation and aims to improve work efficiency in rotating a lever held at a connection position toward an initial position and a retracted position.

SUMMARY

The invention is directed to a lever-type connector with a connector body. A terminal accommodation chamber is formed in the connector body and has a terminal insertion opening that opens in an outer surface of the connector body. A terminal fitting can be inserted through the terminal insertion opening and into the terminal accommodation chamber. A lever is mounted on the connector body and can be rotated from an initial position to a connection position when connecting the lever-type connector to a mating connector. The lever can be located at a retracted position not corresponding to the terminal insertion opening when inserting the terminal fitting into the terminal accommodation chamber. A separation restricting lock arm is formed on either the connector body or the lever and can lock the lever at the connection position so that rotation toward the initial position is restricted. However, the separation restricting lock arm can be deformed resiliently to unlock the lever so that the lever can rotate toward the initial position. An excessive rotation restricting lock arm is formed on either the connector body or the lever. The excessive rotation restricting lock arm can lock the lever at the connection position where rotation toward the retracted position is restricted and can be deformed resiliently to unlock the lever and allow the lever to rotate toward the retracted position.

The separation restricting lock arm and the excessive rotation restricting lock arm hold the lever at the connection position. The lever is rotated to the initial position for connecting the lever-type connector to the mating connector. This operation is performed merely by resiliently deforming the separation restricting lock arm. Thus, work efficiency is good. Further, the lever is rotated from the connection position to the retracted position for maintenance or the like. This operation is performed merely by deforming the excessive rotation restricting lock arm. Thus, work efficiency again is good.

A separation restricting lock on the separation restricting lock arm and an excessive rotation restricting lock on the excessive rotation restricting lock arm may be at different positions in a width direction parallel to a rotary shaft of the lever. Accordingly, the separation restricting lock and the excessive rotation restricting lock do not interfere with each other in the width direction. Thus, a degree of design freedom in arranging the separation restricting lock and the excessive rotation restricting lock is high.

The separation restricting lock arm and the excessive rotation restricting lock arm may be arranged to partially overlap in a side view parallel to the rotary shaft of the lever. According to this configuration, an arrangement space for the separation restricting lock portion and the excessive rotation restricting lock portion can be small in a rotating direction of the lever so that the connector can be miniaturized.

The separation restricting lock arm may be formed with a separation restricting unlocking portion configured for resiliently displacing the separation restricting lock arm in an unlocking direction. The separation restricting unlocking portion may be arranged in a central part of the connector body or the lever in a width direction parallel to a rotary shaft of the lever. An operation of unlocking the separation restricting lock arm is performed more frequently than an operation of unlocking the excessive rotation restricting lock arm. Accordingly, the separation restricting unlocking portion is arranged in the widthwise central part where the separation restricting unlocking portion is operated easily.

A cutout may be formed in a widthwise central part parallel to a rotary shaft of the lever. An unlocking operation restricting portion may be formed in the cutout and may be configured to impede pressing the excessive rotation restricting lock arm in an unlocking direction. The widthwise central part of the excessive rotation restricting lock arm is an easily pressed area. However, the unlocking operation restricting portion prevents the excessive rotation restricting lock arm from being pressed inadvertently in the unlocking direction.

A separation restricting unlocking portion configured to resiliently displace the separation restricting lock arm in an unlocking direction and an unlocking operation restricting portion configured to impede the excessive rotation restricting lock arm from being pressed in an unlocking direction may be at the same position in a width direction parallel to a rotary shaft of the lever on an outer surface of the connector body. A rotating portion of the lever may be formed with an escaping recess for avoiding interference with the separation restricting unlocking portion and avoiding interference with the unlocking operation restricting portion. Accordingly, the escaping recess can be used commonly for the separation restricting unlocking portion and the unlocking operation restricting portion. Thus, the shape of the rotating portion can be simplified.

DETAILED DESCRIPTION

Figure 1:
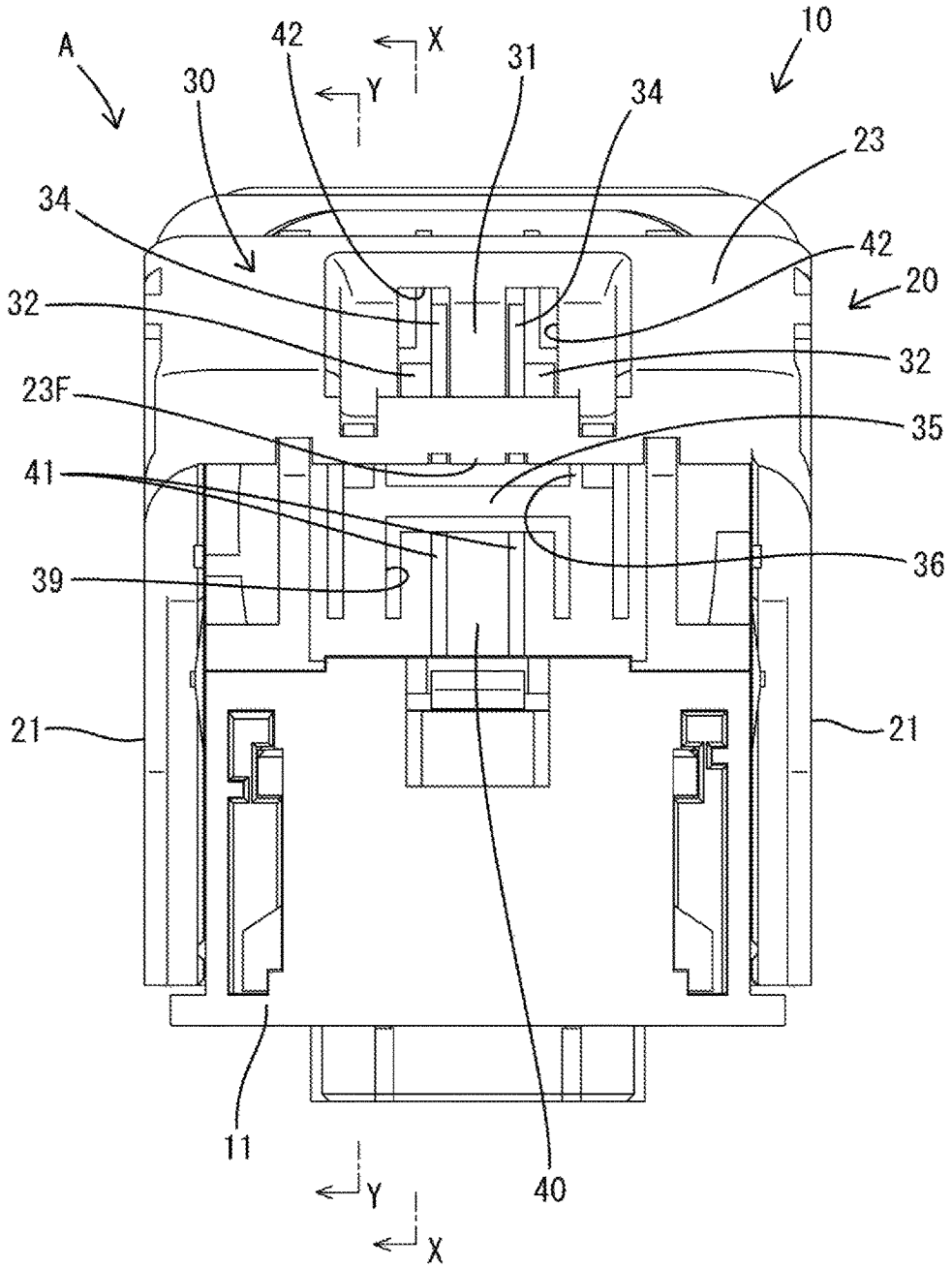
FIG. 1 is a front view showing a state where a lever is at a connection position in one embodiment.
Figure 2:
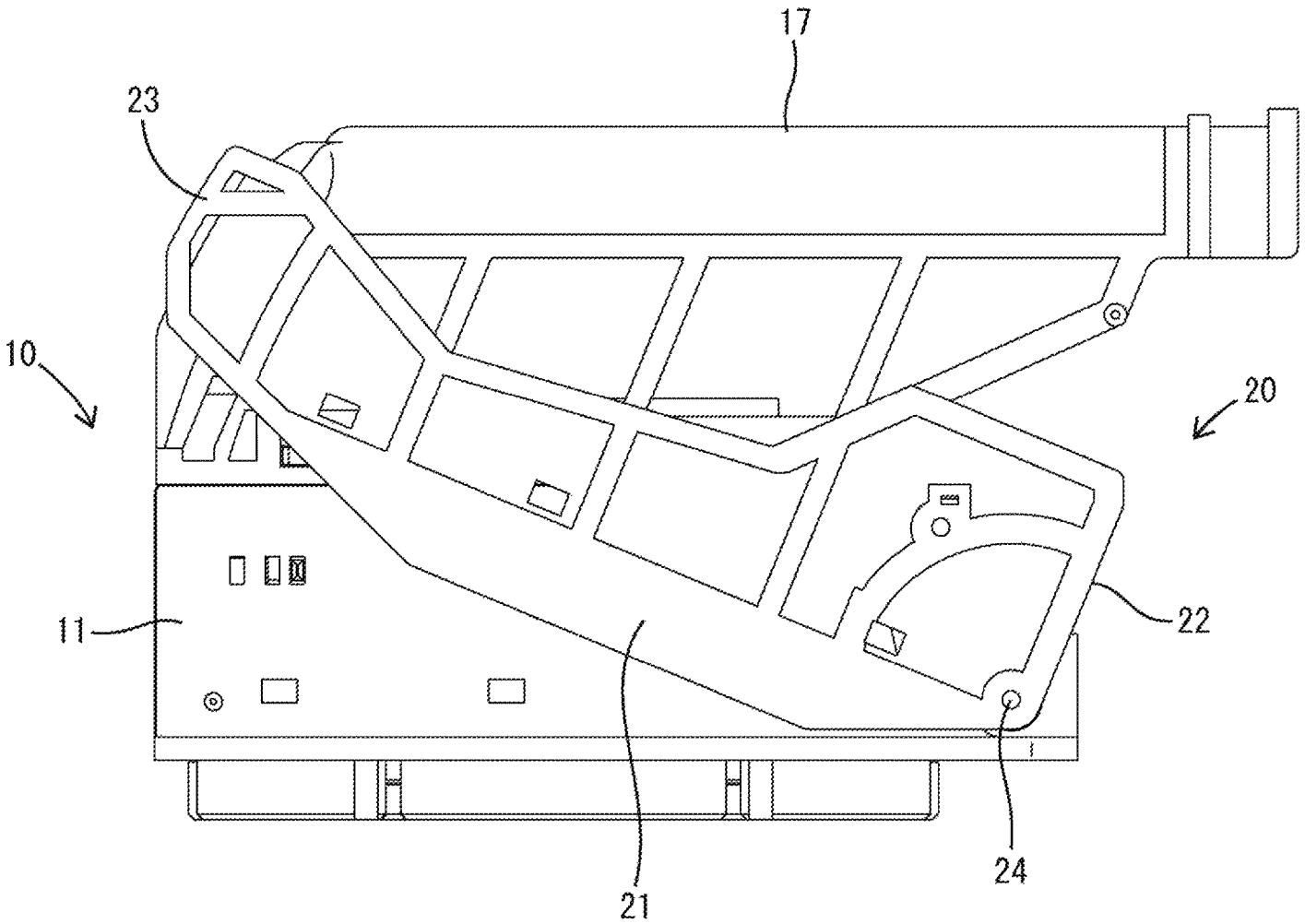
FIG. 2 is a side view in the state where the lever at the connection position.

An embodiment of the invention is described with reference to FIGS. 1 to 13. Note that, in the following description, a left side in FIGS. 2 to 8 is defined as a front side concerning a front-rear direction. Upper and lower sides shown in FIGS. 1 to 8 and 10 to 12 are directly defined as upper and lower sides concerning a vertical direction.

A lever-type connector A according to this embodiment includes a connector body 10, terminal fittings 13, a lever 20 and left and right sliders 25. The connector body 10 is configured by assembling a housing 11 made of synthetic resin and a wire cover 17 made of synthetic resin. Terminal accommodation chambers 12 are formed in the housing 11 and are elongated in the vertical direction. The terminal fitting 13 are inserted respectively into the terminal accommodation chambers 12 from above the housing 11 (see FIG. 10). Upper end parts of the respective terminal accommodation chambers 12 are open as terminal insertion openings 16 in a wire draw-out surface 15 on the upper end of the housing 11. A wire 14 connected to the terminal fitting 13 is drawn out upward of the housing 11 from the terminal insertion opening 16.

The wire cover 17 has a box shape with open rear end surface and lower end surface, and is mounted on the housing 11 to cover the entire area (all the terminal insertion openings 16) of the wire draw-out surface 15. The wire cover 17 is mounted on the housing 11 by being slid rearward along the wire draw-out surface 15 from the front of the housing 11. In detaching the wire cover 17 from the housing 11, the wire cover 17 is slid forward with respect to the housing 11.

The wires drawn out upward from the wire draw-out surface 15 are bent to extend rearward in the wire cover 17 and pulled out rearwardly of the wire cover 17. With the wire cover 17 mounted on the housing 11, a front surface 17F (see FIGS. 3 to 6) of the wire cover 17 is inclined down toward the front and obliquely disposed at an angle close to a right angle with respect to the wire draw-out surface 15.

The lever 20 includes two bilaterally symmetrical plate-like arms 21, a plate-like coupling 22 couples base ends of the arms 21 and a rotating portion 23 couples tips of the arms 21 to form an enclosed frame. Rotary shafts 24 project in on the base ends of the arms 21 and have axes oriented in laterally in a width direction. The lever 20 is mounted on the housing 11 (connector body 10) by fitting the rotary shafts 24 into rear end parts of the housing 11. With the lever 20 mounted on the housing 11, the arms 21 face left and right outer side surfaces of the connector body 10 (housing 11 and wire cover 17).

The lever 20 is rotatable between a retracted position (see FIGS. 9 and 10) and an initial position (see FIGS. 7 and 12) about the rotary shafts 24. A connection position (see FIGS. 1 to 6 and 8) is set between the retracted position and the initial position in a rotating path of the lever 20. In the process of rotating the lever 20 between the retracted position and the initial position, the arms 21 rotate along the left and right outer side surfaces of the housing 11 and the wire cover 17 and the rotating portion 23 rotates while facing the front surface of the housing 11 and the front and upper surfaces of the wire cover 17.

The sliders 25 are accommodated in the housing 11 and move parallel to the front-rear direction (direction perpendicular to a connecting direction of the lever-type connector A and a mating connector B). A drive shaft 27 of the lever 20 is fit into a driven groove 26 formed in a rear end part of the slider 25, and the slider 25 slides in the front-rear direction as the lever 20 is rotated. The slider 25 is formed with cam grooves 28 in which cam followers C of the mating connector B are slidable.

With the lever 20 located at the retracted position, the rotating portion 23 is disposed below the wire draw-out surface 15 and the wire cover 17. Operations of mounting and detaching wire cover 17 on and from the housing 11 while sliding the lever 20 in the front-rear direction are performed with the lever 20 rotated to the retracted position. Further, with the wire cover 17 detached from the housing 11, the lever 20 does not overlap in the range of the wire draw-out surface 15 (opening area of all the terminal insertion openings 16) in a plan view. Thus, an operation of inserting the terminal fittings 13 into the terminal accommodation chambers 12 and an operation of withdrawing the terminal fittings 13 in the terminal accommodation chambers 12 are performed with the lever 20 rotated to the retracted position. Note that, with the lever 20 at the retracted position, the rotating portion 23 is disposed to face the front end surface of the housing 11 (connector body 10) and to project forward from the front end of the connector body 10.

With the lever 20 at the initial position, the rotating portion 23 is located above a rear part of the wire cover 17, i.e. above the upper surface of the wire cover 17. With the wire cover 17 detached from the housing 11, the rotating portion 23 is above a rear end part of the wire draw-out surface 15. In other words, the rotating portion 23 overlaps the rear end part of the wire draw-out surface 15 in a plan view. Thus, the rotating portion 23 possibly obstructs the operation of inserting or withdrawing the terminal fittings 13 into or out of the terminal insertion openings 16 in the rear end part of the wire draw-out surface 15.

With the lever 20 located at the connection position, the rotating portion 23 is substantially parallel to the front surface 17F of the wire cover 17 and proximately facing the front end surface 17F of the wire cover 17. With the wire cover 17 detached from the housing 11, the rotating portion 23 is above a front part of the wire draw-out surface 15. In other words, the rotating portion 23 overlaps the front part of the wire draw-out surface 15 in a plan view. Thus, in the terminal insertion openings 16 arranged in the front part of the wire draw-out surface 15 the rotating portion 23 possibly obstructs the operation of inserting or withdrawing the terminal fittings 13.

The wire cover 17 is detached to assemble the lever-type connector A. The sliders 25 and the lever 20 then are mounted to the housing 11, and the lever 20 is held at the retracted position. The terminal fittings 13 then are inserted respectively into the terminal accommodation chambers 12, and the wire cover 17 is reassembled with the housing 11 from the front after all of the terminal fittings 13 are inserted. The lever 20 then is rotated from the connection position to complete the assembly, and the assembled lever-type connector A then is transported to a site for connection to the mating connector B.

With the lever 20 located at the connection position, the rotating portion 23 of the lever 20 is on the front end of the lever 20 and the front end of the lever 20 is located substantially at the same position as the front end of the connector body 10 (housing 11 and wire cover 17) in the front-rear direction. That is, the rotating portion 23 (front end part of the lever 20) does not project farther forward than the front end of the connector body 10. Thus, a length of the lever-type connector A in the front-rear direction does not become longer by keeping the lever 20 at the connection position.

Similarly, with the lever 20 located at the connection position, the rotating portion 23 is on the upper end of the lever 20 and the upper end of the lever 20 is lower than the upper end of the connector body 10 (wire cover 17) in the vertical direction. That is, the rotating portion 23 (upper end part of the lever 20) does not project farther up than the upper end of the connector body 10. Thus, a height of the lever-type connector A does not become larger by keeping the lever 20 at the connection position. Therefore, the lever 20 can be held at the connection position for transporting and storing the lever-type connector A.

When connecting the lever-type connector A and the mating connector B, the mating connector B is fit lightly from below the connector body 10 and the cam followers C are inserted into the cam grooves 28 with the lever 20 held at the initial position. The lever 20 then is rotated toward the connection position (counterclockwise in FIG. 7) and the sliders 25 are slid forward. As the sliders 25 move, the cam grooves 28 and the cam followers C slide in contact to proceed with the connection of the connectors A, B. The connection of the connectors A, B is completed when the lever 20 reaches the connection position.

The connectors A, B can be separated by rotating the lever 20 from the connection position toward the initial position. As the lever 20 is rotated, the sliders 25 slide rearward and the connectors A, B are separated vertically by the sliding contact of the cam grooves 28 and the cam followers C. When the lever 20 reaches the initial position, the cam followers C reach the entrances of the cam grooves 28 and the connectors A, B may be pulled apart vertically.

The lever-type connector A of this embodiment is provided with a locking means 30 for holding the lever 20 at the connection position. The locking means 30 includes a separation restricting lock arm 31 integrally formed to the wire cover 17, an excessive rotation restricting lock arm 35 integrally formed to the wire cover 17, separation restricting locking portions 43 integrally formed to the rotating portion 23 of the lever 20 and excessive rotation restricting locking portions 44 integrally formed to the rotating portion 23.

The separation restricting lock arm 31 is a plate cantilevered obliquely forward to the front from the upper end of the front surface 17F of the wire cover 17. The separation restricting lock arm 31 is resiliently deformable in an unlocking direction with an upper end thereof as a support. A displacing direction of the separation restricting lock arm 31 during unlocking is oblique toward a lower-rear side (direction approaching the front surface 17F of the wire cover 17). The separation restricting lock arm 31 is at a substantially center position of the connector body 10 (wire cover 17) in a width direction (direction parallel to the rotary shafts 24 of the lever 20).

Two separation restricting locks 32 project bilaterally symmetrically on the front surface (outer surface) of a lower extending part of the separation restricting lock arm 31. The separation restricting lock 32 has a separation restricting lock surface 33 substantially at a right angle to a displacing direction of the rotating portion 23 when the rotation of the lever 20 at the connection position toward the initial position is started and faces down.

Two bilaterally symmetrical separation restricting unlocking portions 34 are formed on the front surface of the separation restricting lock arm 31. The separation restricting unlocking portion 34 is a flat plate whose plate thickness direction is oriented in the width direction. The separation restricting lock 32 projects from a widthwise outer side surface of a lower end part of the separation restricting unlocking portion 34. By pressing the separation restricting unlocking portions 34 from an oblique upper-front side, the separation restricting lock arm 31 can be resiliently deformed in the unlocking direction.

The excessive rotation restricting lock arm 35 is a plate cantilevered obliquely toward an upper-rear from the lower end of the front surface 17F of the wire cover 17. The excessive rotation restricting lock arm 35 is resiliently deformable in the unlocking direction with a lower part thereof as a support. A displacing direction of the excessive rotation restricting lock arm 35 during unlocking is oblique toward the lower-rear side (direction approaching the front surface 17F of the wire cover 17) similar to the unlocking direction of the separation restricting lock arm 31.

The excessive rotation restricting lock arm 35 is at a center position of the connector body 10 (wire cover 17) in the width direction and has a width larger than the separation restricting lock arm 31. The excessive rotation restricting lock arm 35 and the separation restricting lock arm 31 are independent lock arms individually resiliently displaceable.

The upper end of the excessive rotation restricting lock arm 35 is higher than the lower end of the separation restricting lock arm 31. A recess 36 for avoiding interference with a lower end part of the separation restricting lock arm 31 is formed in an upper part of the excessive rotation restricting lock arm 35. The recess 36 is formed by cutting a widthwise central part of the excessive rotation restricting lock arm 35. The recess 36 is substantially rectangular when viewed from the front of the connector body 10 (wire cover 17). By forming the recess 36, two bilaterally symmetrical lock pieces 37 are cantilevered up on the upper end part of the excessive rotation restricting lock arm 35.

An excessive rotation restricting lock 38 projects on the front surface of each of the lock pieces 37. The excessive rotation restricting lock 38 has an excessive rotation restricting lock surface 39 that faces up at a substantially right angle to a displacing direction of the rotating portion 23 when the rotation of the lever 20 at the connection position toward the retracted position is started. The two excessive rotation restricting locks 38 and the two separation restricting locks 32 are at different positions in the width direction. Specifically, the excessive rotation restricting locks 38 are arranged across the two separation restricting locks 32 arranged in a widthwise central part of the wire cover 17 in the width direction. Further, a lower part of the separation restricting lock arm 31 and an upper part of the excessive rotation restricting lock arm 35 overlap in a side view when the wire cover 17 is viewed in a direction parallel to the width direction.

A cutout 39 is formed by cutting a widthwise central part of the excessive rotation restricting lock arm 35 in a lower part of the excessive rotation restricting lock arm 35 and is substantially rectangular in a front view. An unlocking operation restricting portion 40 is arranged in the cutout 39 projects from the front surface 17F of the wire cover 17. The unlocking operation restricting portion 40 is hardly displaced and deformed with respect to the wire cover 17 is more rigid than the separation restricting lock arm 31 and the excessive rotation restricting lock arm 35.

Two bilaterally symmetrical restricting projections 41 are formed on the front surface of the unlocking operation restricting portion 40. The restricting projections 41 are plates whose plate thickness direction is oriented in the width direction, and are disposed below the lower end of the separation restricting lock arm 31 and below the excessive rotation restricting locks 38. Further, the two restricting projections 41 are formed in the widthwise central part of the wire cover 17. The restricting projections 41 and the separation restricting unlocking portions 34 are at the same positions in the width direction.

The restricting projections 41 project farther forward than the front surface of the excessive rotation restricting lock arm 35. Thus, when a worker brings a finger toward the excessive rotation restricting lock arm 35 from the front of the wire cover 17, the finger touches the restricting projection 41 before contacting the front surface of the excessive rotation restricting lock arm 35. Thus, to deform the excessive rotation restricting lock arm 35 in the unlocking direction, the finger must shift either left or right from the widthwise central part to press the front surface of the excessive rotation restricting lock arm 35.

The rotating portion 23 of the lever 20 has two bilaterally symmetrical escaping recesses 42. Each escaping recess 42 has a rectangular shape long in a circumferential direction parallel to the rotating direction of the lever 20 and penetrates from the outer surface to the inner surface of the rotating portion 23. The escaping recesses 42 are at the same positions as the separation restricting unlocking portions 34 and the restricting projections 41 in the width direction. Further, an opening area of the escaping recess 42 in the width direction extends in a range including the separation restricting lock 32.

The rotating portion 23 has two outer edges extending along the width direction. The edge on a front side in the rotating direction when the lever 20 rotates from the initial position to the connection position is defined as a connecting direction front edge part 23F. Two bilaterally symmetrical separation restricting locks 43 are formed on the inner surface of the connecting direction front edge part 23F. The separation restricting locks 43 are in a widthwise central part of the rotating portion 23 (lever 20), i.e. at the same positions as the separation restricting locks 32 in the width direction. Similarly, two bilaterally symmetrical excessive rotation restricting locks 44 are formed on the inner surface of the connecting direction front edge part 23F. The excessive rotation restricting locks 44 are at positions across the separation restricting locks 43 in the width direction, i.e. at the same positions as the pair of excessive rotation restricting locks 38 in the width direction.

Next, functions and effects of this embodiment are described. When the lever 20 is rotated to the connection position, the rotating portion 23 is disposed at a position facing a lower end area of the separation restricting lock arm 31 and the upper end part (lock pieces 37) of the excessive rotation restricting lock arm 35. Further, the separation restricting unlocking portions 34 enter the escaping recesses 42 to project from the front surface (outer surface) of the rotating portion 23. That is, the separation restricting unlocking portions 34 are exposed on the outer surface of the rotating portion 23 and unlocking can be performed.

Figure 3:
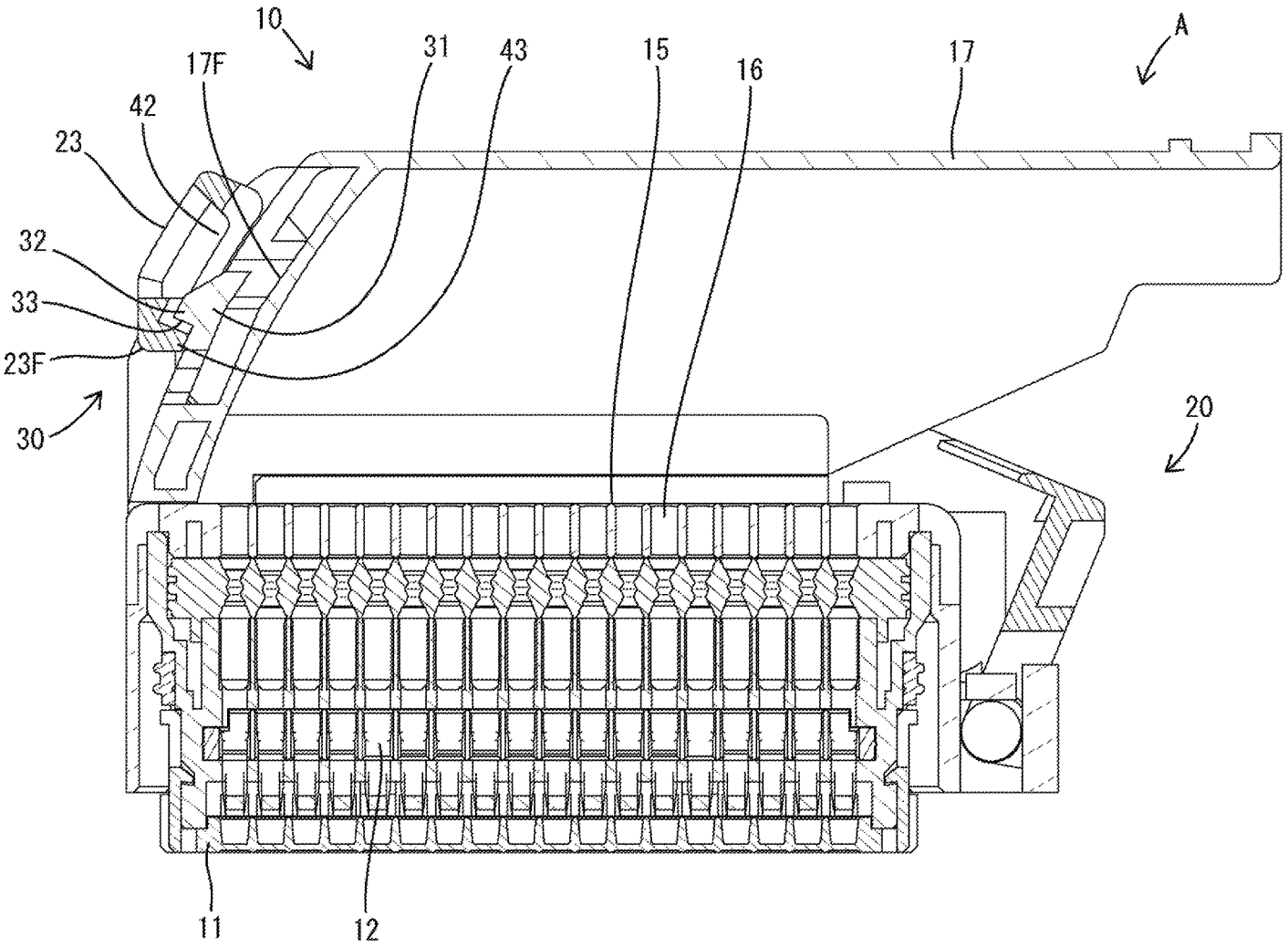
FIG. 3 is a section along X-X of FIG. 1 showing a state where the rotation of the lever toward an initial position is restricted.
Figure 5:
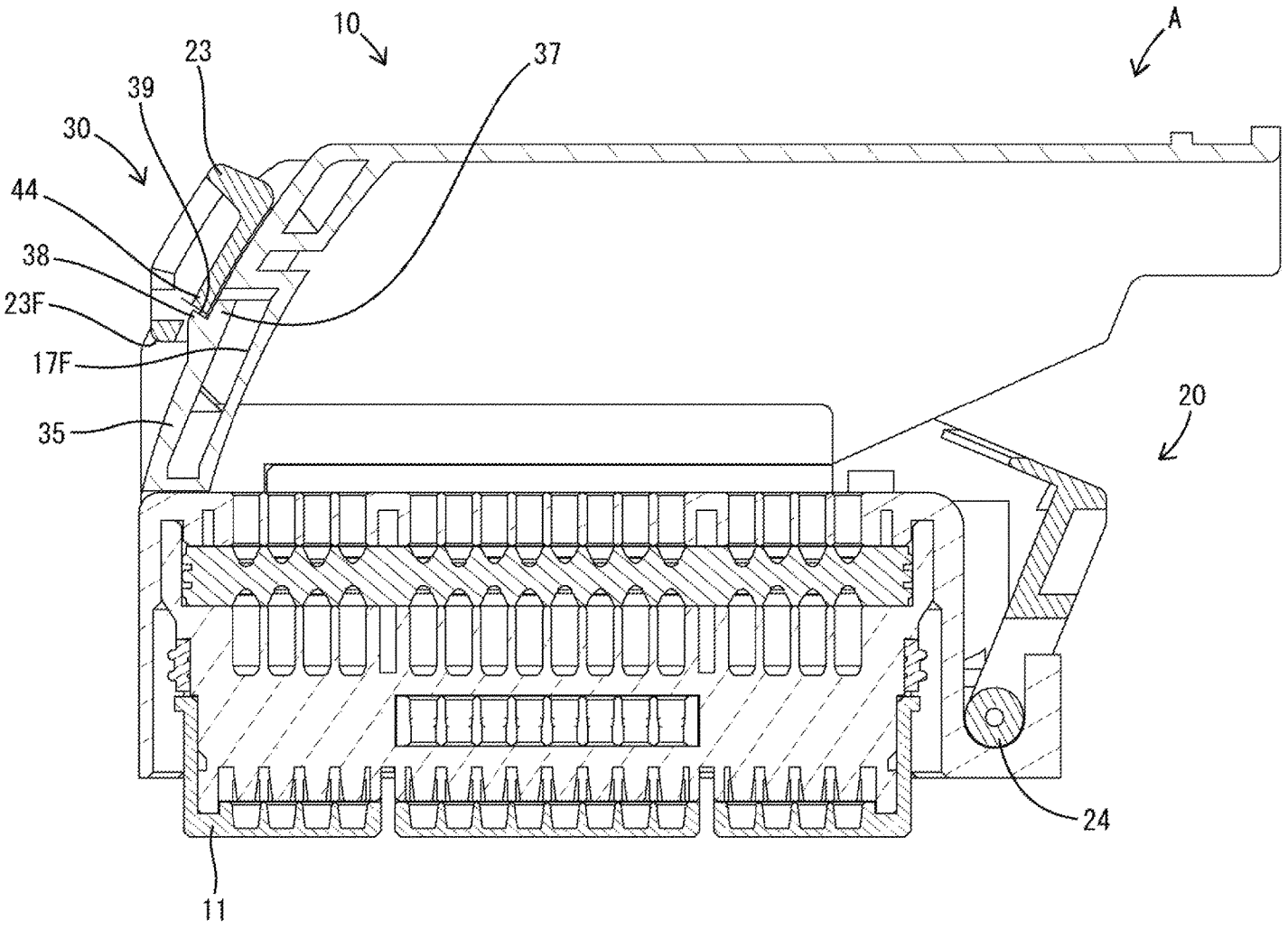
FIG. 5 is a section along Y-Y of FIG. 1 showing the state where the rotation of the lever toward a retracted position is restricted.

As shown in FIG. 3, the separation restricting locking portions 43 of the rotating portion 23 face the separation restricting locks 32 from below to be lockable to the separation restricting locks 32. Thus, the lever 20 cannot rotate toward the initial position (direction to separate the both connectors A, B, clockwise direction in FIG. 3). Further, as shown in FIG. 5, since the excessive rotation restricting locks 44 of the rotating portion 23 are facing the excessive rotation restricting locks 38 from above to lock to the excessive rotation restricting locks 38, the rotation of the lever 20 toward the retracted position (counterclockwise direction in FIG. 5) is restricted. That is, even if the lever 20 receives an external force toward the initial position or an external force toward the retracted position, a state is held where the rotation of the lever 20 at the connection position is restricted.

Figure 4:
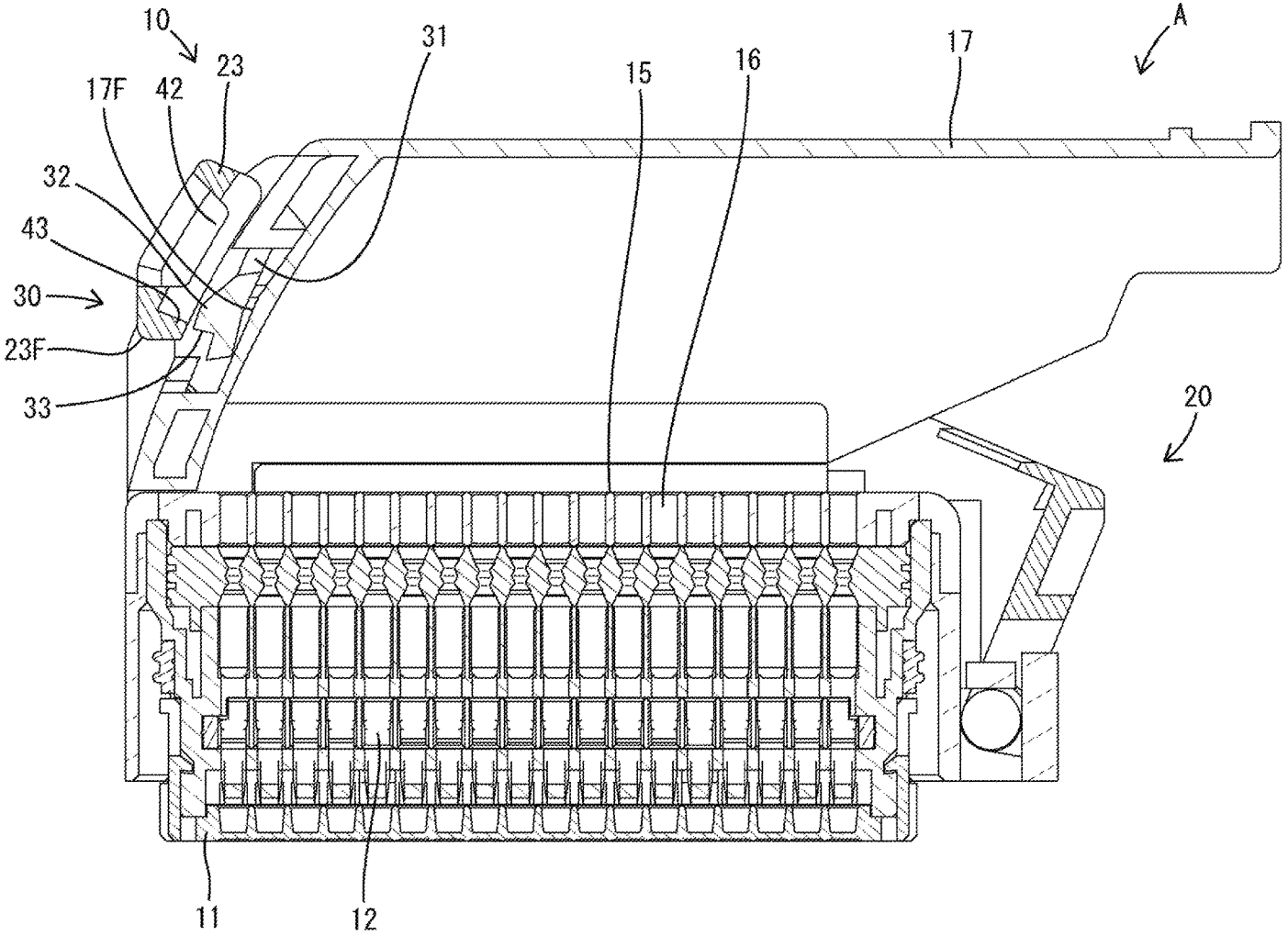
FIG. 4 is a section along X-X of FIG. 1 showing a state where the lever is unlocked to be rotatable toward the initial position.

In rotating the lever 20 toward the initial position from this state, the separation restricting lock arm 31 is displaced resiliently in the unlocking direction by pressing the separation restricting unlocking portions 34. Then, since the separation restricting lock portions 32 are disengaged from the separation restricting locking portions 43, as shown in FIG. 4, the lever 20 enters a state rotatable toward the initial position (clockwise direction in FIG. 4). Work efficiency is good since this unlocking operation is performed merely by pressing the separation restricting unlocking portions 34.

Figure 6:
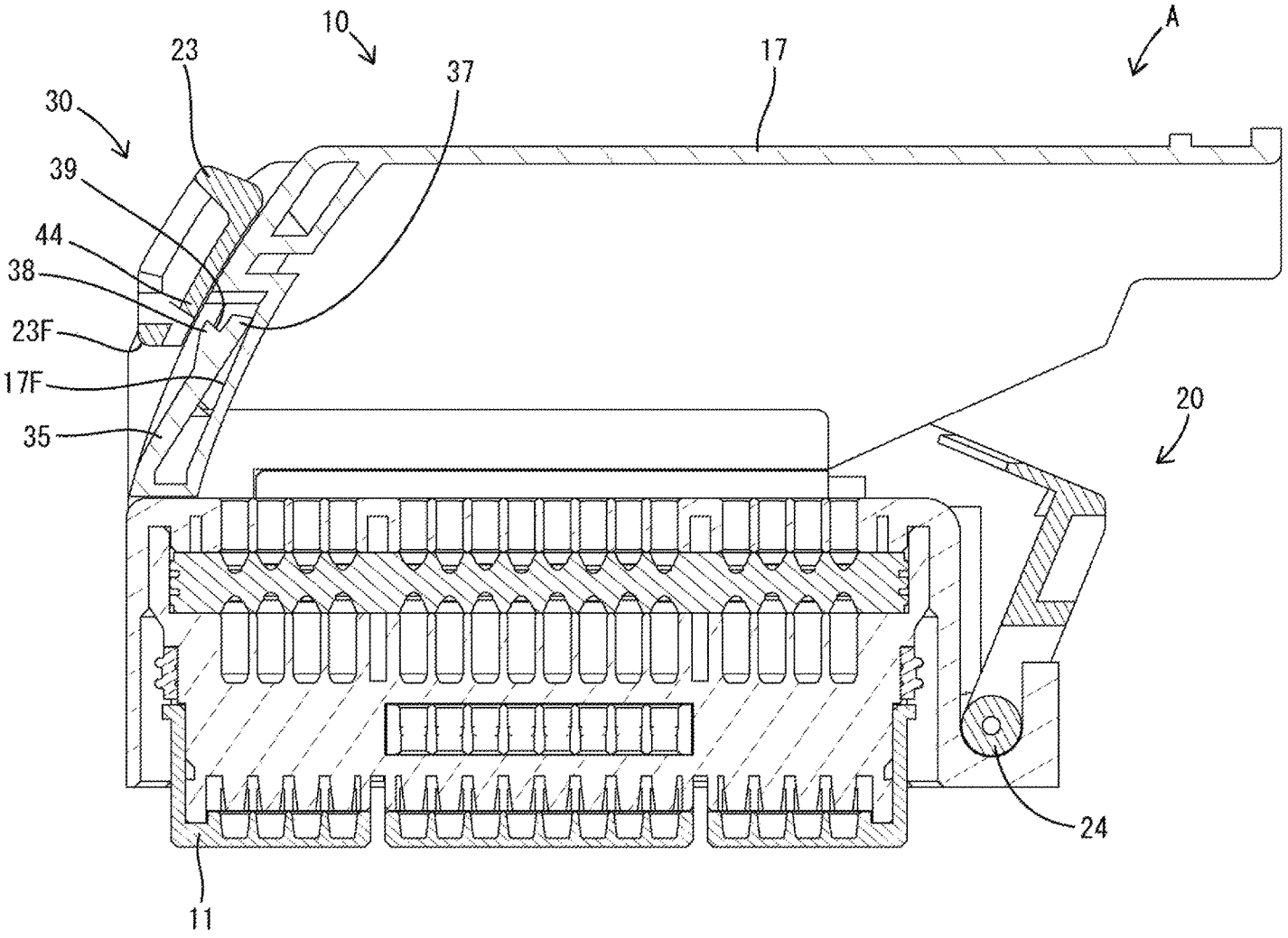
FIG. 6 is a section along Y-Y of FIG. 1 showing the state where the lever is unlocked to be rotatable toward the retracted position.
Figure 7:
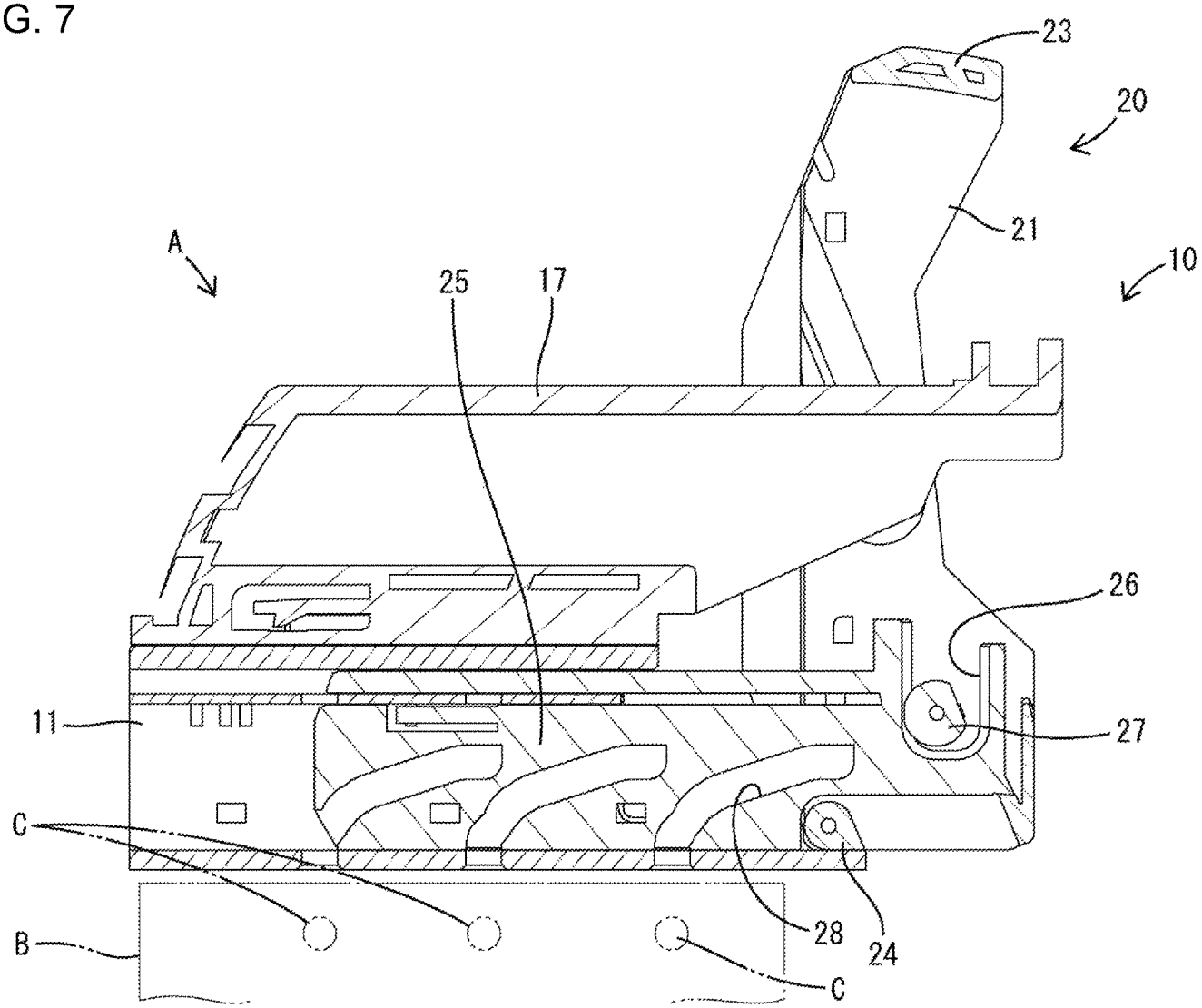
FIG. 7 is a side view in section showing state the lever at the initial position.
Figure 8:
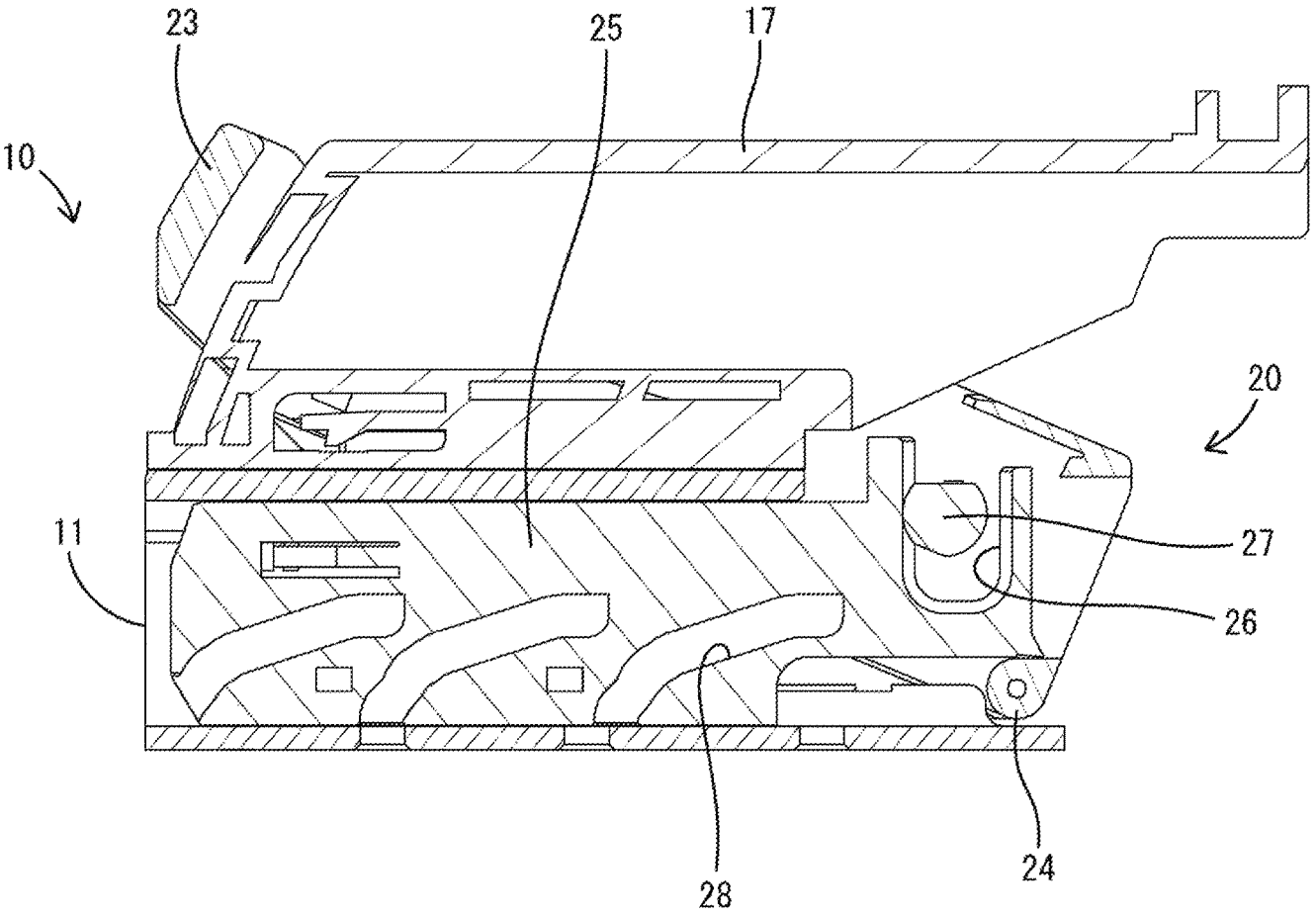
FIG. 8 is a side view in section showing the lever at the connection position.
Figure 9:
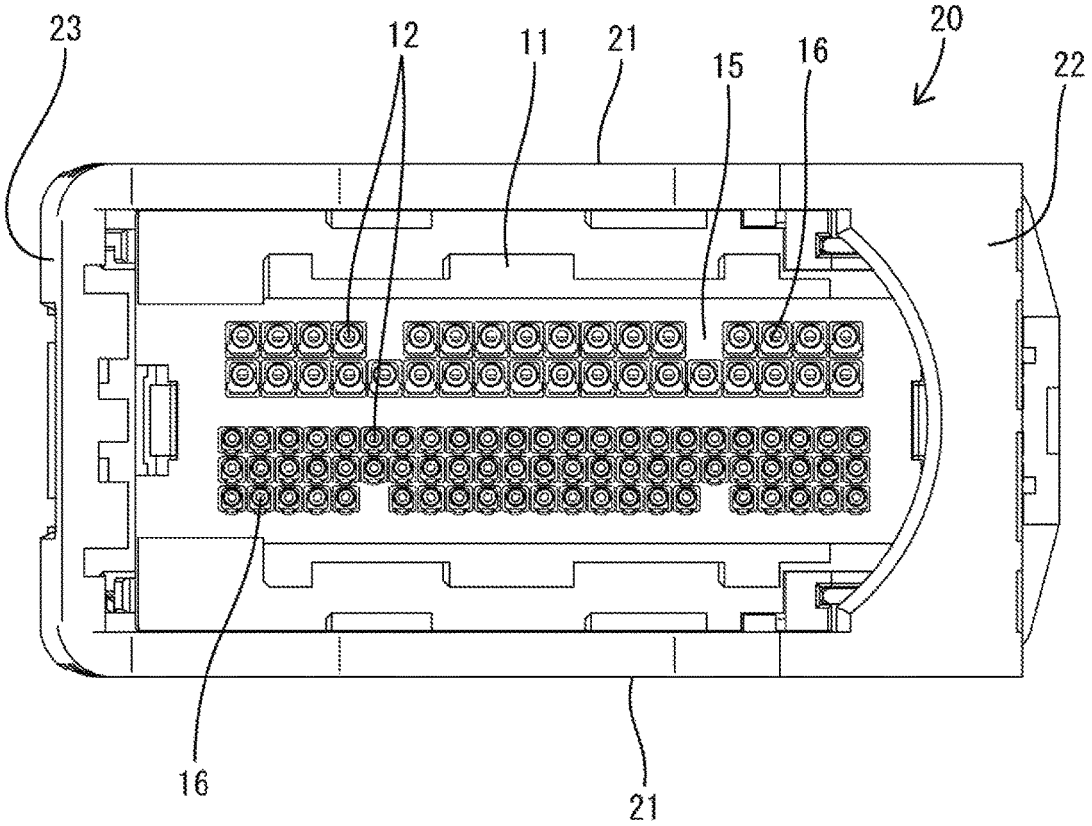
FIG. 9 is a plan view showing a state where the lever is at the retracted position.
Figure 10:
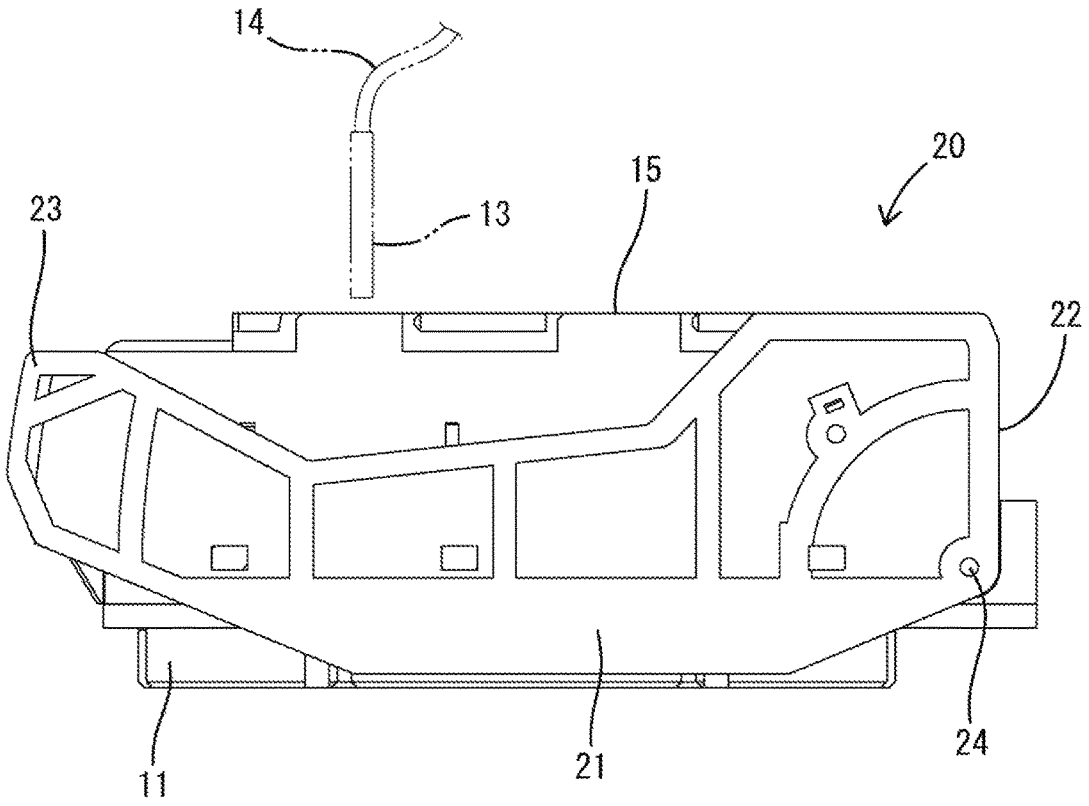
FIG. 10 is a side view showing the state where the lever is at the retracted position.
Figure 11:
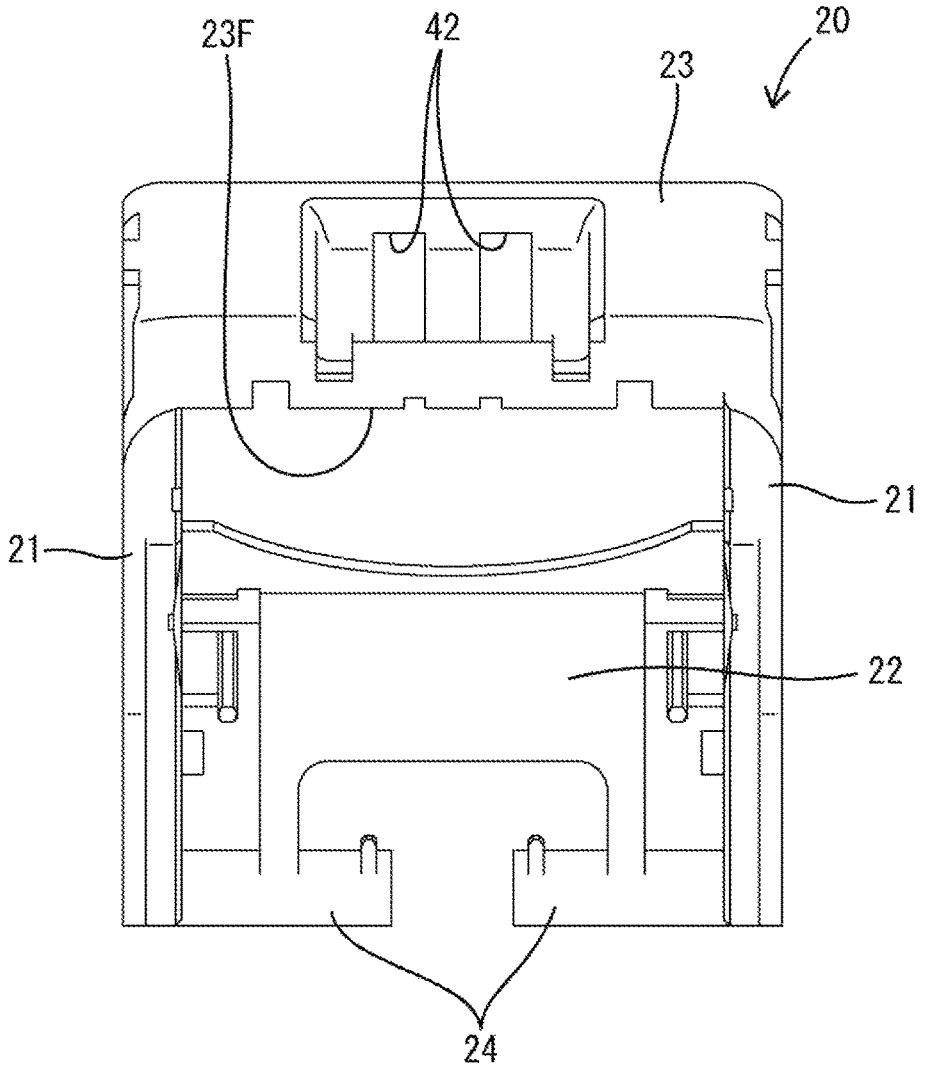
FIG. 11 is a front view when the lever is in the same posture as at the connection position.
Figure 12:
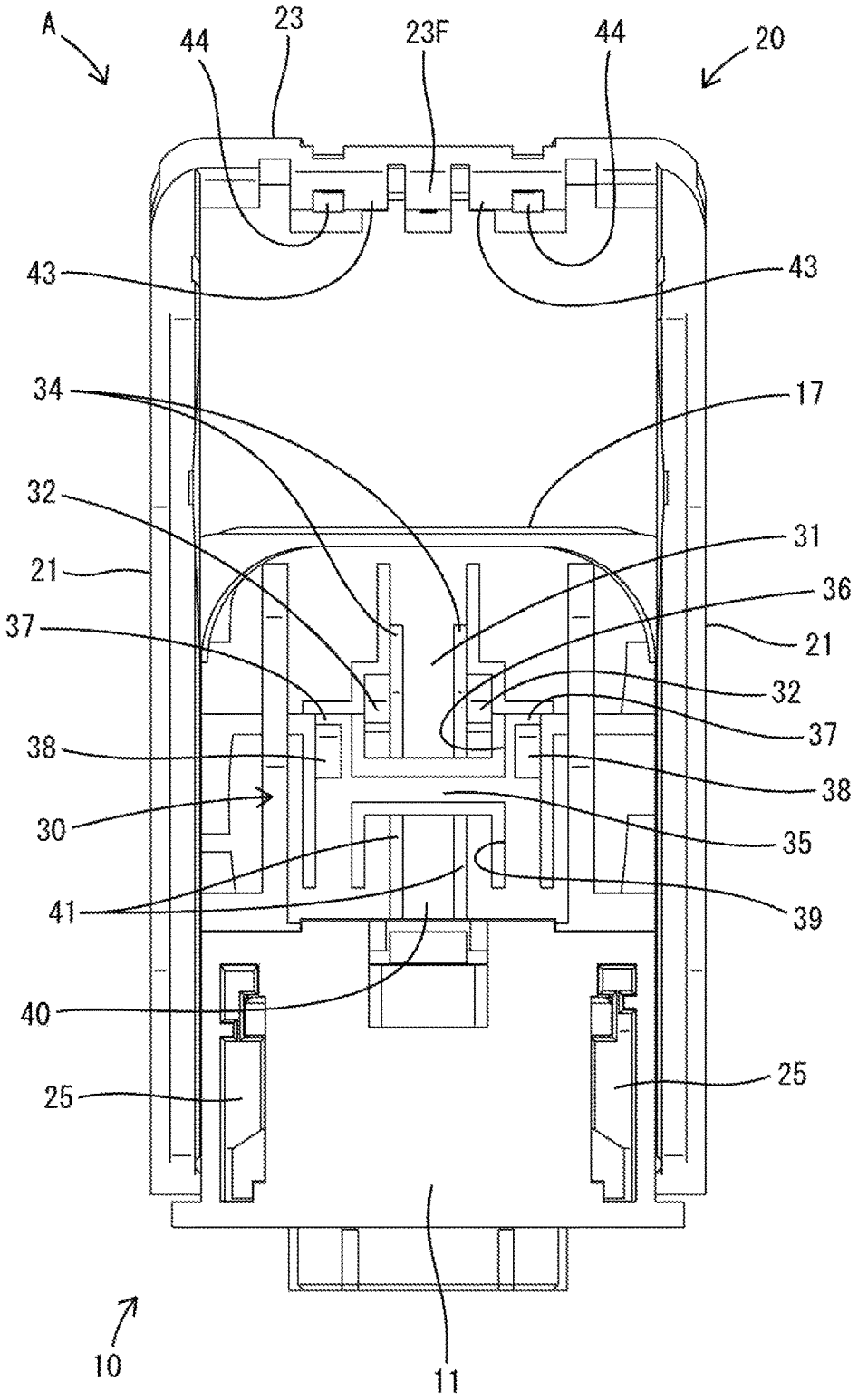
FIG. 12 is a front view showing the state where the lever is at the initial position.
Figure 13:
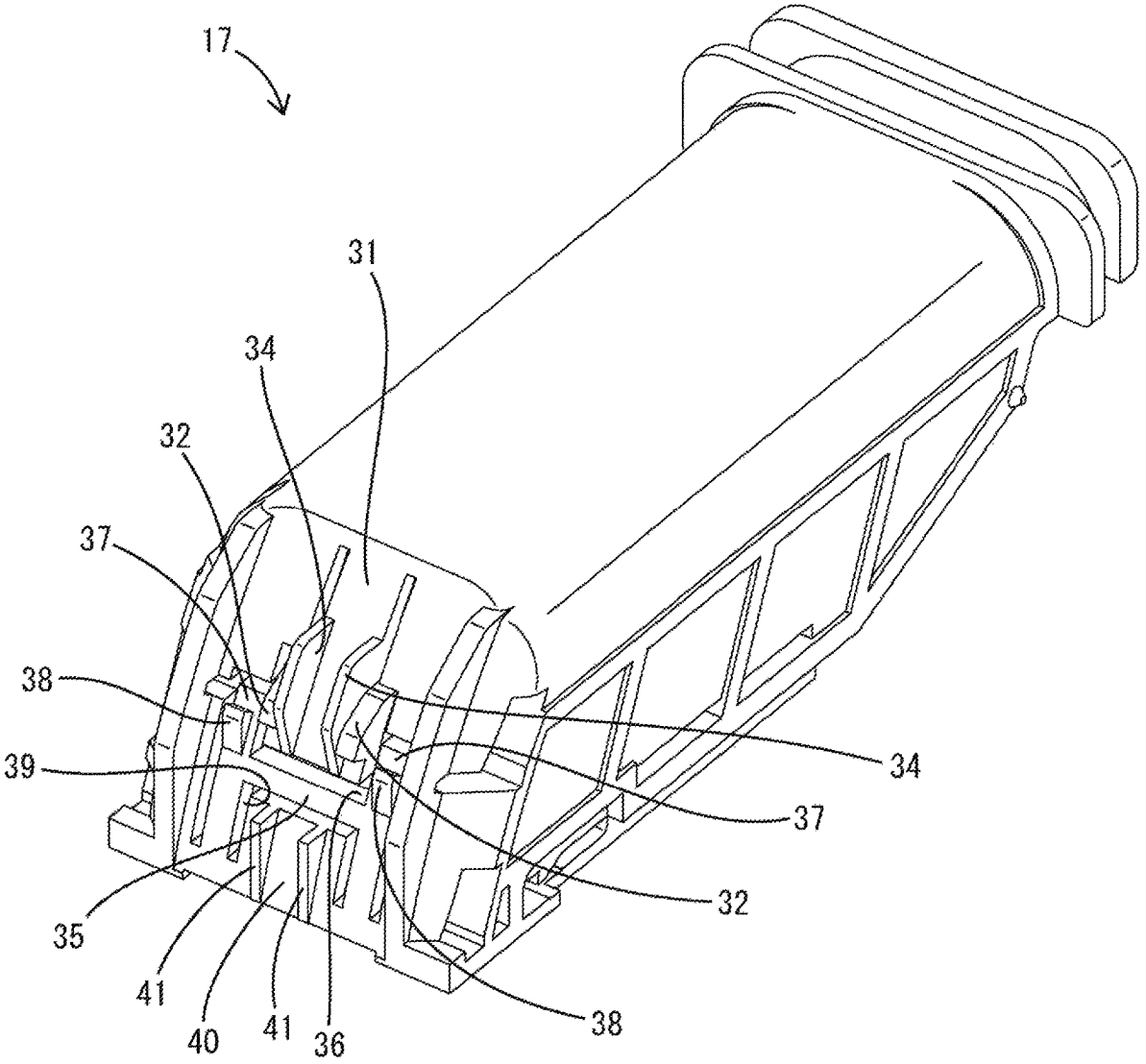
FIG. 13 is a perspective view of a wire cover.

Further, when rotating the lever 20 at the connection position toward the retracted position, the lower part of the excessive rotation restricting lock arm 35, i.e. an area of the excessive rotation restricting lock arm 35 exposed below the rotating portion 23, is pressed. This pressing resiliently displaces the excessive rotation restricting lock arm 35 in the unlocking direction and, as shown in FIG. 6, the excessive rotation restricting locks 38 disengage from the excessive rotation restricting locks 44. In this way, the lever 20 enters a state rotatable toward the retracted position (counterclockwise direction in FIG. 6). Work efficiency is good since this unlocking operation is performed merely by pressing the excessive rotation restricting unlocking portions.

The lever-type connector A of this embodiment includes the connector body 10 formed with the terminal accommodation chambers 12, the terminal fittings 13 to be inserted into the terminal accommodation chambers 12 through the terminal insertion openings 16 open in the outer surface of the connector body 10 and the lever 20 mounted on the connector body 10. The lever 20 is rotated from the initial position to the connection position in connecting the lever-type connector A to the mating connector B and rotated to the retracted position where the lever 20 does not overlap the terminal insertion openings 16 in inserting the terminal fittings 13 into the terminal accommodation chambers 12.

The connector body 10 is formed with the separation restricting lock arm 31 capable of locking the lever 20 at the connection position where rotation toward the initial position is restricted and is configured to deform and unlock the lever 20 so that the lever 20 can rotate toward the initial position. Similarly, the connector body 10 is formed with the excessive rotation restricting lock arm 35 capable of locking the lever 20 at the connection position where rotation toward the retracted position is restricted and is configured to deform and unlock the lever 20 so that the lever 20 can rotate toward the retracted position.

In the lever-type connector A of this embodiment, the lever 20 is held at the connection position by the separation restricting lock arm 31 and the excessive rotation restricting lock arm 35. In connecting the lever-type connector A to the mating connector B, the lever 20 is rotated to the initial position. Since this operation is performed only by resiliently deforming the separation restricting lock arm 31, work efficiency is good. Further, in rotating the lever 20 held at the connection position to the retracted position for maintenance or the like, work efficiency is good since it is sufficient merely to resiliently deform the excessive rotation restricting lock arm 35.

Further, the separation restricting locks 32 formed on the separation restricting lock arm 31 and the excessive rotation restricting locks 38 formed on the excessive rotation restricting lock arm 35 are arranged at the positions different from each other in the width direction parallel to the rotary shafts 24 of the lever 20. According to this configuration, since the separation restricting locks 32 and the excessive rotation restricting locks 38 do not interfere with each other in the width direction, a degree of design freedom in arranging the separation restricting locks 32 and the excessive rotation restricting locks 38 is high.

Further, the separation restricting lock arm 31 and the excessive rotation restricting lock arm 35 partially overlap in a side view parallel to the rotary shafts 24. Specifically, the lower part of the separation restricting lock arm 31 and the upper part (lock pieces 37) of the excessive rotation restricting lock arm 35 are located to overlap in the side view. According to this configuration, since an arrangement space for the separation restricting locks 32 and the excessive rotation restricting locks 38 can be small in the rotating direction of the lever 20, the miniaturization of the connector (height reduction of the wire cover 17) can be achieved.

Further, the separation restricting lock arm 31 is formed with the separation restricting unlocking portions 34 for resiliently displacing the separation restricting lock arm 31 in the unlocking direction. The operation of unlocking the separation restricting lock arm 31 is performed more frequently than the operation of unlocking the excessive rotation restricting lock arm 35. Accordingly, the separation restricting unlocking portions 34 are arranged in the central part of the connector body 10 in the width direction parallel to the rotary shafts 24 of the lever 20. Since the widthwise central part is pressed more easily than widthwise end parts, efficiency is good in pressing the separation restricting unlocking portions 34.

Since the operation of unlocking the excessive rotation restricting lock arm 35 is performed less frequently than the operation of unlocking the separation restricting lock arm 31, it is preferable to provide a means for avoiding inadvertent pressing of the excessive rotation restricting lock arm 35 in the unlocking direction. Accordingly, the cutout 39 is formed in the widthwise central part, which is an area of the excessive rotation restricting lock arm 35 difficult for a worker to press, and the unlocking operation restricting portion 40 for impeding the pressing of the excessive rotation restricting lock arm 35 in the unlocking direction is disposed in the cutout 39. In this way, the excessive rotation restricting lock arm 35 can be prevented from being inadvertently pressed in the unlocking direction.

The separation restricting unlocking portions 34 for resiliently displacing the separation restricting lock arm 31 in the unlocking direction are formed on the front surface 17F of the wire cover 17 (outer surface of the connector body 10). Similarly, the unlocking operation restricting portion 40 for impeding the excessive rotation restricting lock arm 35 from being pressed in the unlocking direction is formed on the front surface 17F of the wire cover 17. After the separation restricting unlocking portions 34 and the unlocking operation restricting portion 40 are arranged at the same position in the width direction, the escaping recesses 42 capable of avoiding interference with the separation restricting unlocking portions 34 and avoiding interference with the unlocking operation restricting portion 40 are formed in the rotating portion 23 of the lever 20. According to this configuration, since the escaping recesses 42 can be used commonly for the separation restricting unlocking portions 34 and the unlocking operation restricting portion 40, the shape of the rotating portion 23 can be simplified.

The invention is not limited to the above described embodiment. For example, the following embodiments also are included in the scope of the invention.

Although both the separation restricting lock arm and the excessive rotation restricting lock arm are provided on the connector body in the above embodiment, both the separation restricting lock arm and the excessive rotation restricting lock arm may be provided on the lever or either one of the separation restricting lock arm and the excessive rotation restricting lock arm may be provided on the connector body and the other may be provided on the lever.

Although the separation restricting lock arm and the excessive rotation restricting lock arm are independent lock arms individually resiliently displaceable with each other in the above embodiment, the separation restricting lock arm and the excessive rotation restricting lock arm may be integrally resiliently displaceable as one lock arm.

Although the separation restricting lock arm and the excessive rotation restricting lock arm are arranged at the positions different from each other in the direction parallel to the rotary shafts of the lever in the above embodiment, the separation restricting lock arm and the excessive rotation restricting lock arm may be arranged at the same position in the direction parallel to the rotary shafts of the lever and arranged side by side along the rotating direction of the lever.

Although the separation restricting lock arm and the excessive rotation restricting lock arm are arranged to partially overlap in the side view parallel to the rotary shafts of the lever in the above embodiment, the separation restricting lock arm and the excessive rotation restricting lock arm may be so arranged as not to overlap in the side view parallel to the rotary shafts of the lever.

Although the separation restricting lock portions are arranged in the widthwise central part and the pair of excessive rotation restricting lock portions are arranged across the separation restricting lock portions in the width direction in the above embodiment, the excessive rotation restricting lock portions may be conversely arranged in the widthwise central part and the pair of separation restricting lock portions may be arranged across the excessive rotation restricting lock portions in the width direction.

Although the separation restricting unlocking portions are arranged in the widthwise central part in the above embodiment, the separation restricting unlocking portions may be arranged at positions laterally deviated from the widthwise central part.

Although the unlocking operation restricting portion is arranged in the widthwise central part in the above embodiment, the unlocking operation restricting portion may be arranged at a position laterally deviated from the widthwise central part.

Although the separation restricting unlocking portions and the unlocking operation restricting portion are arranged at the same position in the width direction in the above embodiment, the separation restricting unlocking portions and the unlocking operation restricting portion may be at positions different from each other in the width direction.

Although the lever is assembled with the connector body from above (from the side of the wire draw-out surface) in the above embodiment, the lever may be assembled with the connector body from below.

In the above embodiment, the rotating portion of the lever is disposed at the position facing the wire draw-out surface (position where the insertion and withdrawal of the terminal fittings into and from the terminal insertion openings are impeded) when the lever is at the connection position. However, the rotating portion of the lever may be disposed at a position not facing the wire draw-out surface when the lever is at the connection position.

Although application to such a lever-type connector that a rotating force of the lever is transmitted to the sliders has been described in the above embodiment, the present invention can be applied also to lever-type connectors including no slider.

Although both the separation restricting lock arm and the excessive rotation restricting lock arm are provided only on the wire cover, out of the housing and the wire cover constituting the connector body, in the above embodiment, both the separation restricting lock arm and the excessive rotation restricting lock arm may be provided only on the housing or one of the separation restricting lock arm and the excessive rotation restricting lock arm may be provided on the housing and the other may be provided on the wire cover.

LIST OF REFERENCE SIGNS

A . . . lever-type connector
B . . . mating connector
10 . . . connector body
12 . . . terminal accommodation chamber
13 . . . terminal fitting
16 . . . terminal insertion opening
20 . . . lever
23 . . . rotating portion
24 . . . rotary shaft
31 . . . separation restricting lock arm
32 . . . separation restricting lock
34 . . . separation restricting unlocking portion
35 . . . excessive rotation restricting lock arm
38 . . . excessive rotation restricting lock
39 . . . cutout
40 . . . unlocking operation restricting portion
42 . . . escaping recess

What is claimed is:

1. A lever-type connector, comprising:

a connector body;

a terminal fitting to be inserted into a terminal accommodation chamber through a terminal insertion opening open in an outer surface of the connector body;

a lever to be mounted on the connector body, rotated from an initial position to a connection position in connecting the lever-type connector to a mating connector and located at a retracted position spaced from the terminal insertion opening in inserting the terminal fitting into the terminal accommodation chamber;

a separation restricting lock arm formed on either one of the connector body and the lever, capable of locking the lever at the connection position in a state where rotation toward the initial position is restricted and configured to unlock the lever and allow the lever to rotate toward the initial position by being resiliently deformed; and an excessive rotation restricting lock arm formed on either one of the connector body and the lever, capable of locking the lever at the connection position in a state where rotation toward the retracted position is restricted and configured to unlock the lever and allow the lever to rotate toward the retracted position by being resiliently deformed.

2. The lever-type connector of claim 1, wherein a separation restricting lock formed on the separation restricting lock arm and an excessive rotation restricting lock formed on the excessive rotation restricting lock arm are arranged at positions different from each other in a width direction parallel to a rotary shaft of the lever.

3. The lever-type connector of claim 2, wherein the separation restricting lock arm and the excessive rotation restricting lock arm are arranged to partially overlap in a side view parallel to the rotary shaft of the lever.

4. The lever-type connector of claim 3, wherein:

the separation restricting lock arm is formed with a separation restricting unlocking portion configured to resiliently displace the separation restricting lock arm in an unlocking direction; and the separation restricting unlocking portion is arranged in a central part of the connector body or the lever in a width direction parallel to a rotary shaft of the lever.

5. The lever-type connector of claim 4, wherein:

a cutout is formed in a widthwise central part parallel to a rotary shaft of the lever; and an unlocking operation restricting portion formed in the cutout and configured to impede the excessive rotation restricting lock arm from being pressed in an unlocking direction is.

6. The lever-type connector of claim 5, wherein:

a separation restricting unlocking portion configured to resiliently displace the separation restricting lock arm in an unlocking direction and an unlocking operation restricting portion configured to impede the excessive rotation restricting lock arm from being pressed in an unlocking direction are disposed at the same position in a width direction parallel to a rotary shaft of the lever on an outer surface of the connector body; and a rotating portion of the lever is formed with an escaping recess capable of avoiding interference with the separation restricting unlocking portion and avoiding interference with the unlocking operation restricting portion.

7. The lever-type connector of claim 1, wherein:

the separation restricting lock arm is formed with a separation restricting unlocking portion configured to resiliently displace the separation restricting lock arm in an unlocking direction; and the separation restricting unlocking portion is arranged in a central part of the connector body or the lever in a width direction parallel to a rotary shaft of the lever.

8. The lever-type connector of claim 1, wherein:

a cutout is formed in a widthwise central part parallel to a rotary shaft of the lever; and an unlocking operation restricting portion formed in the cutout and configured to impede the excessive rotation restricting lock arm from being pressed in an unlocking direction is.

9. The lever-type connector of claim 1, wherein:

a separation restricting unlocking portion configured to resiliently displace the separation restricting lock arm in an unlocking direction and an unlocking operation restricting portion configured to impede the excessive rotation restricting lock arm from being pressed in an unlocking direction are disposed at the same position in a width direction parallel to a rotary shaft of the lever on an outer surface of the connector body; and a rotating portion of the lever is formed with an escaping recess capable of avoiding interference with the separation restricting unlocking portion and avoiding interference with the unlocking operation restricting portion.

* * * * *